US010327566B2

(12) United States Patent
Mountz

(10) Patent No.: US 10,327,566 B2
(45) Date of Patent: Jun. 25, 2019

(54) INFANT CARRIER AND SWING DEVICE THEREWITH

(71) Applicant: Wonderland Switzerland AG, Steinhausen (CH)

(72) Inventor: Jonathan K. Mountz, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 97 days.

(21) Appl. No.: 15/628,659

(22) Filed: Jun. 21, 2017

(65) Prior Publication Data

US 2017/0367493 A1 Dec. 28, 2017

Related U.S. Application Data

(60) Provisional application No. 62/354,971, filed on Jun. 27, 2016.

(51) Int. Cl.

| | |
|---|---|
| ***A47D 1/10*** | (2006.01) |
| ***A47D 13/02*** | (2006.01) |
| ***A47D 13/10*** | (2006.01) |

(52) U.S. Cl.

CPC ..... *A47D 13/02* (2013.01); *A47D 1/10* (2013.01); *A47D 13/025* (2013.01); *A47D 13/105* (2013.01); *A47D 13/107* (2013.01); *A47D 13/10* (2013.01)

(58) Field of Classification Search

CPC ..... A47D 13/02; A47D 1/10; A47D 13/025; A47D 13/105; A47D 13/107

USPC ..... 297/377, 256.16, 16.1, DIG. 11, 274; 472/118, 119

See application file for complete search history.

(56) References Cited

U.S. PATENT DOCUMENTS

| | | | | |
|---|---|---|---|---|
| 3,054,591 | A * | 9/1962 | Cohn | A47D 13/107 248/419 |
| 3,096,963 | A * | 7/1963 | Welsh | A47D 13/107 248/439 |
| 6,089,653 | A * | 7/2000 | Hotaling | A47D 1/002 297/130 |
| 6,540,292 | B2 * | 4/2003 | Darling | A47D 13/102 297/130 |
| 7,695,374 | B2 * | 4/2010 | Bellows | A47D 13/107 297/16.1 |
| 7,779,490 | B2 * | 8/2010 | Bergkvist | A47D 13/10 297/DIG. 11 |
| 8,602,903 | B2 * | 12/2013 | Gilbert | A63G 13/02 472/119 |

(Continued)

FOREIGN PATENT DOCUMENTS

WO WO2013139960 A1 * 9/2013 ..... A47D 13/105

*Primary Examiner* — Syed A Islam

(74) *Attorney, Agent, or Firm* — Winston Hsu

(57) ABSTRACT

An infant carrier includes an upper frame, a seat mount frame, a base frame, and at least one folding mechanism. The seat mount frame is pivoted to the upper frame. The base frame is pivoted to the seat mount frame. The at least one folding mechanism is disposed between the seat mount frame and base frame and for allowing the seat mount frame to pivot relative to the base frame between an unfolded position and a folded position. In such a way, when the infant carrier is not in use, it can provide convenient way to fold infant carrier by operating the at least one folding mechanism for easy storage and transportation.

31 Claims, 8 Drawing Sheets

(56) References Cited

U.S. PATENT DOCUMENTS

| | | | | |
|---|---|---|---|---|
| 8,845,028 | B2 * | 9/2014 | Miller | A47D 1/002<br>297/118 |
| 8,920,253 | B2 * | 12/2014 | Horst | A47D 13/105<br>472/118 |
| 9,750,350 | B2 * | 9/2017 | Armbruster | A47D 9/02 |
| 2016/0157633 | A1 * | 6/2016 | Aboukrat | A47D 1/02<br>297/270.4 |

* cited by examiner

INFANT CARRIER AND SWING DEVICE THEREWITH

CROSS REFERENCE TO RELATED APPLICATIONS

This application claims the benefit of U.S. Provisional Patent Application No. 62/354,971 filed on Jun. 27, 2016, which is hereby incorporated by reference in its entirety.

BACKGROUND OF THE INVENTION

1. Field of the Invention

The present invention relates to an infant carrier and a related swing device, and more particularly, to an infant carrier with easy storage and transportation, and a swing device therewith.

2. Description of the Prior Art

An infant carrier can provide a comfortable and safe place for an infant to rest. With advance of technology, there are many types of infant carriers providing different functions. For example, a bouncer can provide gentle vibration to soothe and relax an infant thereon. The bouncer usually has a seat and a wire frame that provides flexible support for the seat, which allows the seat to move up and down by a caregiver or an infant himself/herself. Furthermore, the bouncer can be mounted onto a swing frame for multi-purpose. However, it is not convenient for a user to store or transport the bouncer due to its bulky size.

SUMMARY OF THE INVENTION

Therefore, an objective of the present invention is to provide an infant carrier with easy storage and transportation, and a swing device therewith for solving aforementioned problems.

In order to achieve the aforementioned objective, the present invention discloses an infant carrier including an upper frame, a seat mount frame, a base frame, and at least one folding mechanism. The seat mount frame is pivoted to the upper frame. The base frame is pivoted to the seat mount frame. The at least one folding mechanism is disposed between the seat mount frame and base frame and for allowing the seat mount frame to pivot relative to the base frame between an unfolded position and a folded position.

According to an embodiment of the present invention, the at least one folding mechanism includes a fold bracket, a slot configuration, and a pin. The fold bracket is pivoted on the seat mount frame. The slot configuration is disposed on the fold bracket. The pin is disposed on the base frame and inserts into the slot configuration to restrain the seat mount frame from pivoting relative to the base frame or to allow the seat mount frame to pivot relative to the base frame.

According to an embodiment of the present invention, the slot configuration includes a sliding slot, a first engaging slot and a second engaging slot. The first engaging slot and the second engaging slot are communicated with the sliding slot and disposed at two opposite ends of the sliding slot. The seat mount frame is restrained from pivoting relative to the base frame and respectively positioned in the unfolded position and the folded position when the pin is located within the first engaging slot and the second engaging slot, and the seat mount frame is allowed to pivot relative to the base frame when the pin is located within the sliding slot.

According to an embodiment of the present invention, the sliding slot is substantially perpendicular to the first engaging slot and the second engaging slot.

According to an embodiment of the present invention, the at least one folding mechanism further includes a fold actuator attached onto the fold bracket and for driving the fold bracket to slide the pin in the slot configuration.

According to an embodiment of the present invention, the at least one folding mechanism further includes a resilient component for biasing the fold bracket to engage the pin inside the first engaging slot or the second engaging slot.

According to an embodiment of the present invention, the base frame includes a first end pivoted to the seat mount frame. The infant carrier further includes a bounce wire connected to the first end of the base frame and extending away from the seat mount frame.

According to an embodiment of the present invention, the base frame includes a first end and a second end opposite to the first end. The first end is pivoted to the seat mount frame. The infant carrier further includes a mounting pod disposed on the second end of the base frame.

According to an embodiment of the present invention, amounting slot is formed on the mounting pod, and a shape of the mounting slot matches with a shape of a cross section of a mounting receiver of a device.

According to an embodiment of the present invention, the shape of the mounting slot and the shape of the cross section of the mounting receiver are axially symmetric-shaped.

According to an embodiment of the present invention, the shape of the mounting slot and the shape of the cross section of the mounting receiver are radial-shaped or regular polygon-shaped.

According to an embodiment of the present invention, the infant carrier further includes at least one recline mechanism disposed between the upper frame and the seat mount frame and for allowing the upper frame to pivot relative to the seat mount frame.

According to an embodiment of the present invention, the upper frame is pivoted to an upper portion of the seat mount frame, and the base frame is pivoted to a lower portion of the seat mount frame.

According to an embodiment of the present invention, the seat mount frame includes a seat mount bracket and a seat mount tube, and a lower portion of the seat mount tube is received in the seat mount bracket.

In order to achieve the aforementioned objective, the present invention discloses a swing device includes an infant carrier and a swing assembly. The infant carrier includes an upper frame, a seat mount frame, a base frame, and at least one folding mechanism, and a mounting pod. The seat mount frame is pivoted to the upper frame. The base frame is pivoted to the seat mount frame. The at least one folding mechanism is disposed between the seat mount frame and base frame and for allowing the seat mount frame to pivot relative to the base frame between an unfolded position and a folded position. The mounting pod is disposed on the base frame. The swing assembly is coupled to the mounting pod for swinging the infant carrier.

According to an embodiment of the present invention, the swing assembly includes a main frame and a mounting receiver. The mounting receiver is disposed on an upper surface of the main frame and coupled to the mounting pod.

According to an embodiment of the present invention, the swing assembly includes a main frame, a swing arm, and a mounting receiver. The swing arm is pendulously disposed on the main frame. The mounting receiver is disposed on the swing arm and coupled to the mounting pod.

In summary, the present invention utilizes cooperation of the pin and the slot configuration of the folding mechanism for allowing the seat mount frame to pivot relative to the base frame between an unfolded position and a folded position. Therefore, it provides a convenient way for a user to fold the infant carrier for easy storage and transportation when the infant carrier is not in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
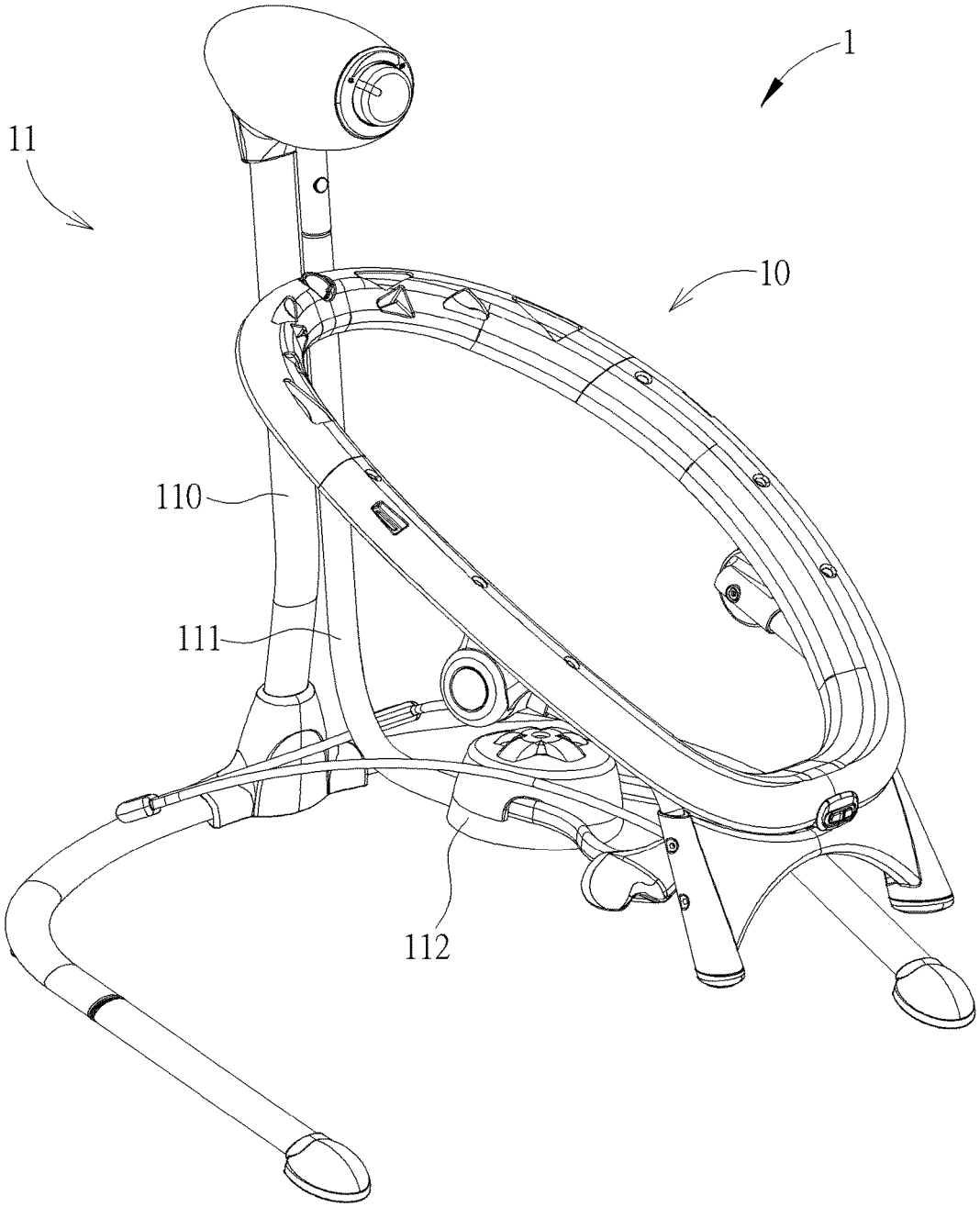
FIG. 1 is a schematic diagram of a swing device according to a first embodiment of the present invention.

Please refer to FIG. 1. FIG. 1 is a schematic diagram of a swing device 1 according to a first embodiment of the present invention. As shown in FIG. 1, the swing device 1 includes an infant carrier 10 and a swing assembly 11. The swing assembly 11 is coupled to the infant carrier 10 for swinging the infant carrier 10. In this embodiment, the infant carrier 10 can be a bouncer. However, it is not limited thereto. The swing assembly 11 is used for swinging the infant carrier 10 and includes a main frame 110, a swing arm 111, and a mounting receiver 112. The swing arm 111 is pendulously disposed on the main frame 110. The mounting receiver 112 is disposed on a lower end of the swing arm 111 and coupled to the infant carrier 10. However, it is not required to mount the infant carrier 10 onto the swing assembly 11 at all times. The infant carrier 10 of the present invention also can be used independently or be mounted onto a supporting assembly other than the swing assembly 11.

Figure 2:
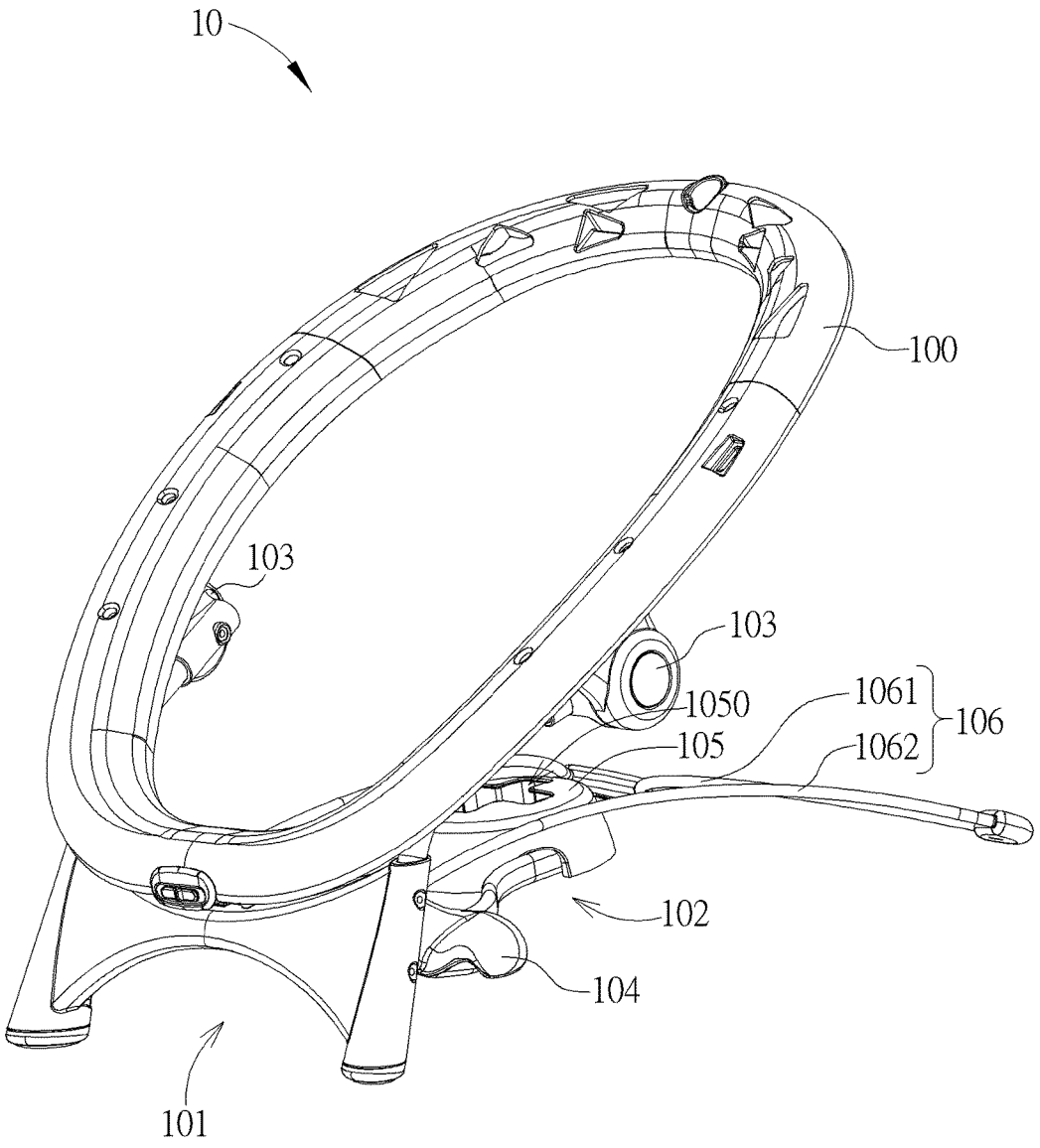
FIG. 2 and FIG. 3 are diagrams of an infant carrier at different views according to the first embodiment of the present invention.
Figure 3:
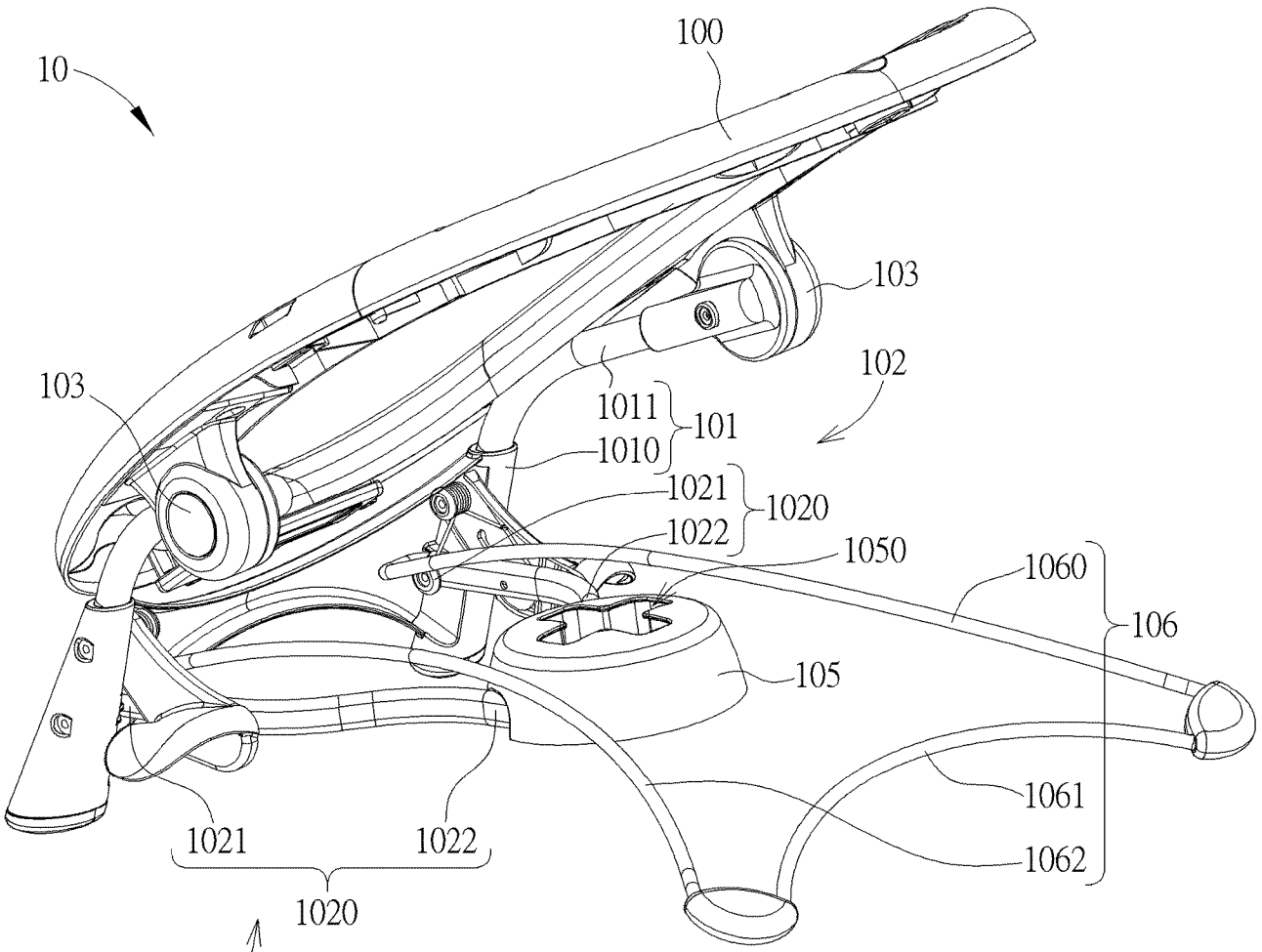

Please refer to FIG. 2 and FIG. 3. FIG. 2 and FIG. 3 are diagrams of the infant carrier 10 at different views according to the first embodiment of the present invention. As shown in FIG. 2 and FIG. 3, the infant carrier 10 includes an upper frame 100, a seat mount frame 101, a base frame 102, two recline mechanisms 103, two folding mechanisms 104, a mounting pod 105, and a bounce wire 106. The seat mount frame 101 includes a seat mount bracket 1010 and a seat mount tube 1011. A lower portion of the seat mount tube 1011 is received in the seat mount bracket 1010. The seat mount tube 1011 is pivoted to the upper frame 100, i.e., the upper frame 100 is pivoted to an upper portion of the seat mount frame 101. The two recline mechanisms 103 are disposed between the upper frame 100 and the seat mount frame 101 and located at two opposite sides of the seat mount frame 101 for allowing the upper frame 100 to pivot relative to the seat mount frame 101, so as to adjust an recline angle of the upper frame 100 relative to the seat mount frame 101. However, the number and the configuration of the recline mechanism 103 are not limited to those illustrated in the figures of this embodiment. For example, in another embodiment, the infant carrier 10 also can only include one recline mechanism 103 located at one side of the seat mount frame 101.

Furthermore, the seat mount bracket 1010 is pivoted to the base frame 102, i.e., the base frame 102 is pivoted to a lower portion of the seat mount frame 101. The two folding mechanisms 104 are disposed between the seat mount frame 101 and base frame 102 and located at two opposite sides of the seat mount frame 101 for allowing the seat mount frame 101 to pivot relative to the base frame 102 between an unfolded position and a folded position. However, the number and the configuration of the folding mechanism 104 are not limited to those illustrated in the figures of this embodiment. For example, in another embodiment, the infant carrier 10 also can only include one folding mechanism 104 located at one side of the seat mount frame 101.

Besides, the base frame 102 includes two base supports 1020. Each of the two base supports 1020 includes a first end 1021 and a second end 1022. The first end 1021 is pivoted to the seat mount bracket 1010 of the seat mount frame 101. The bounce wire 106 includes a first segment 1060, a second segment 1061, and a third segment 1062. Ends of the first segment 1060 and the third segment 1062 of the bounce wire 106 are connected to the first ends 1021 of the two base supports 1020 of the base frame 102 respectively and the other ends of the first segment 1060 and the third segment of the bounce wire 106 extends away from the seat mount frame 101 and connected to the second segment 1061. In such a way, the bounce wire 106 can provide a flexible support. As shown in FIG. 1 to FIG. 3, the mounting pod 105 is disposed on the second ends 1022 of the two base supports 1020 of the base frame 102 for coupling to the mounting receiver 112 of the swing assembly 11, so as to install the infant carrier 10 on the swing assembly 11. In this embodiment, a mounting slot 1050 is formed on the mounting pod 105. A shape of the mounting slot 1050 and a shape of a cross section of the mounting receiver 112 match with each other and are cross-shaped. However, the shapes of the mounting slot 1050 and the cross section of the mounting receiver 112 of the present invention are not limited to this embodiment. Shapes which allow the infant carrier 10 to be mounted onto the swing assembly 11 in different orientations are in the scope of the present invention. That is, the shapes of the mounting slot 1050 and the cross section of the mounting receiver 112 of the present invention can preferably be axially symmetric-shaped, such as radial-shaped or regular polygon-shaped. For example, please refer to FIG. 8A to FIG. 8F. FIG. 8A to FIG. 8F are diagrams of the cross section of the mounting receiver 112 according to different embodiments of the present invention. As shown in FIG. 8A to FIG. 8F, the shape of the cross section of the mounting receiver 112 can be asterisk-shaped, square-shaped, regular pentagon-shaped, regular hexagon-shaped, regular heptagon-shaped, and regular octagon-shaped, respectively. The shape of the mounting slot 1050, which is not shown in FIG. 8A to FIG. 8F, can be configured to match with the shape of the cross section of the mounting receiver 112.

Figure 4:
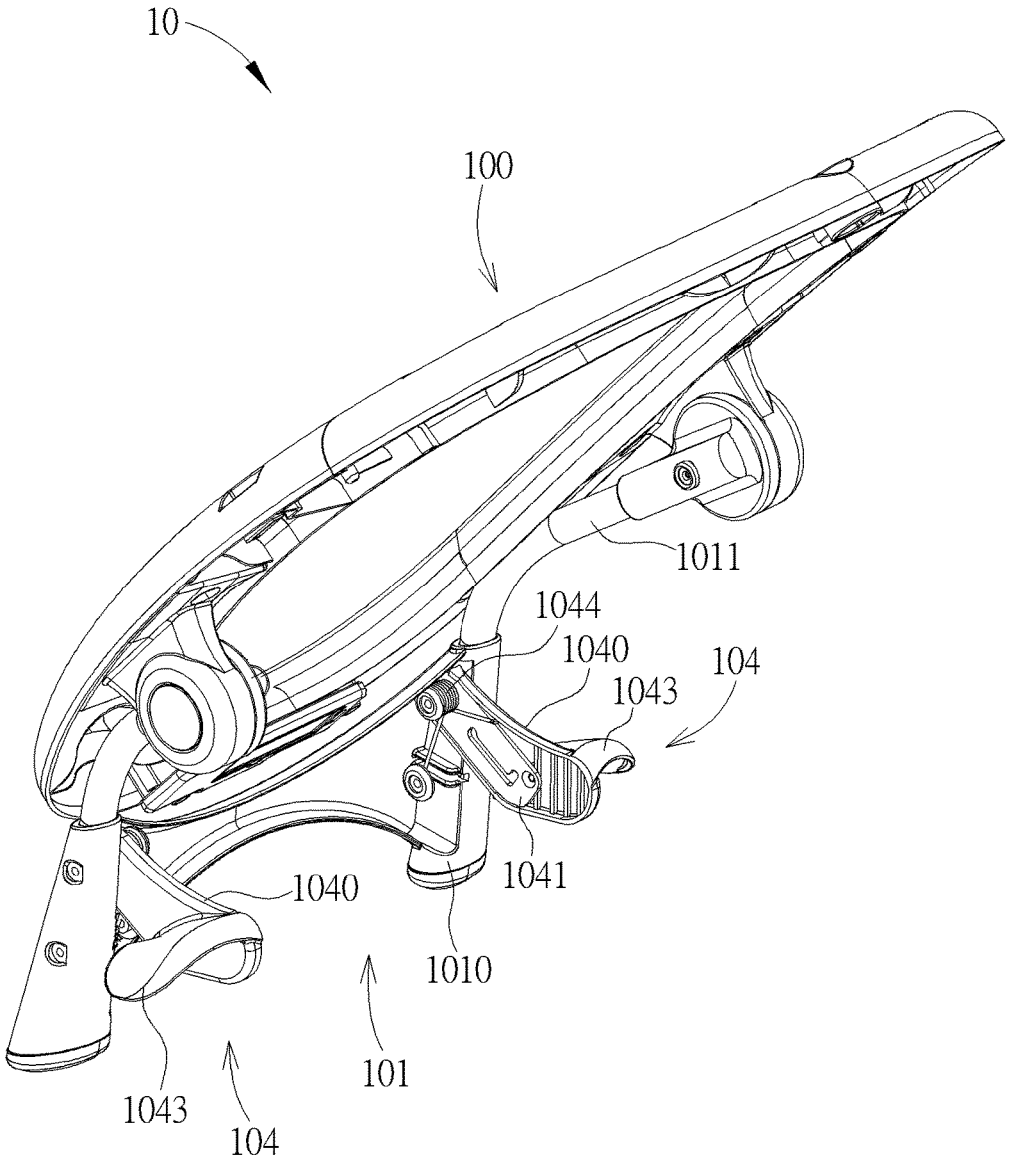
FIG. 4 is a diagram of a folding assembly, a seat mount frame, and an upper frame at different views according to the first embodiment of the present invention.
Figure 5:
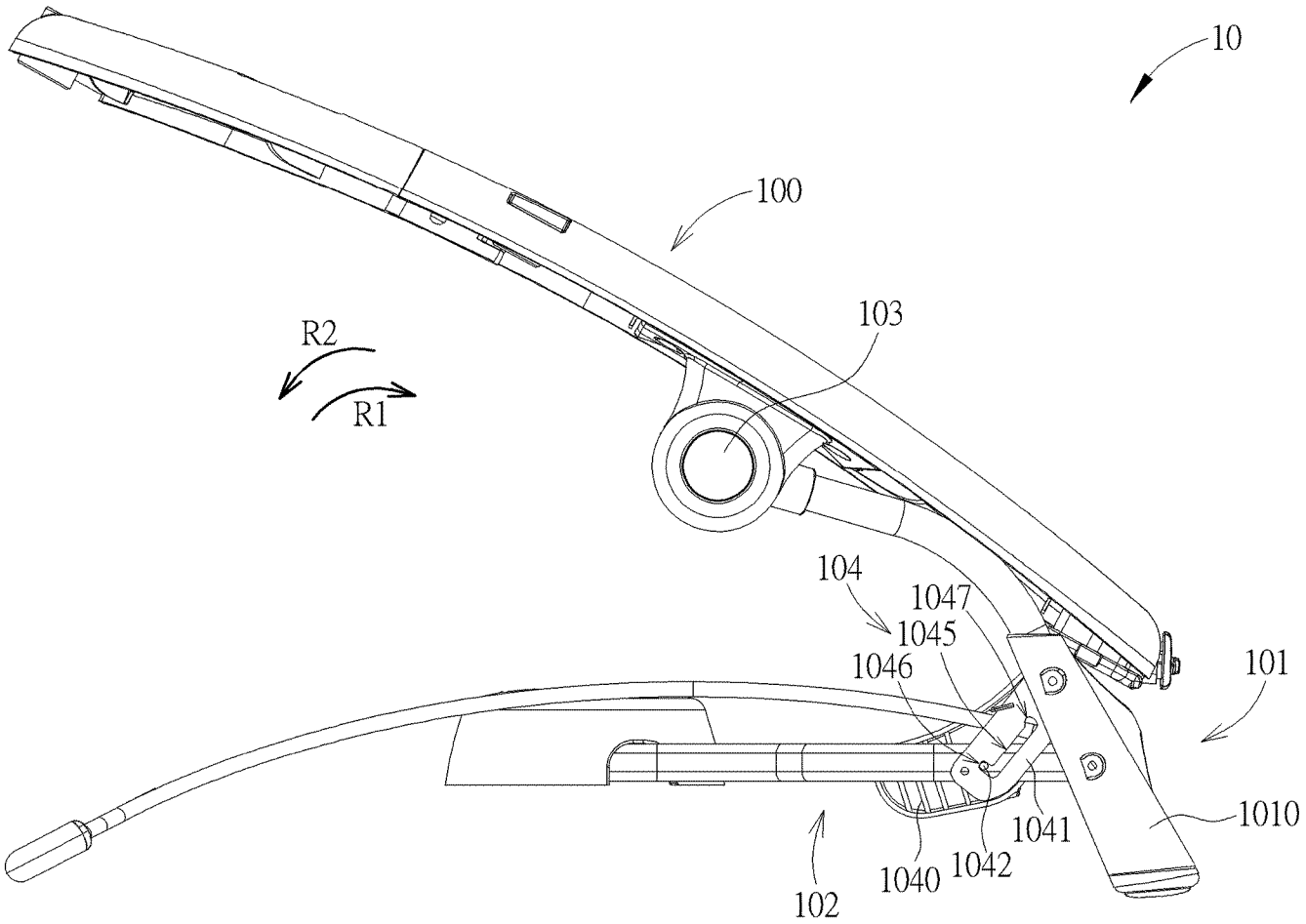
FIG. 5 and FIG. 6 are lateral diagrams of the infant carrier at different states according to the first embodiment of the present invention.
Figure 6:
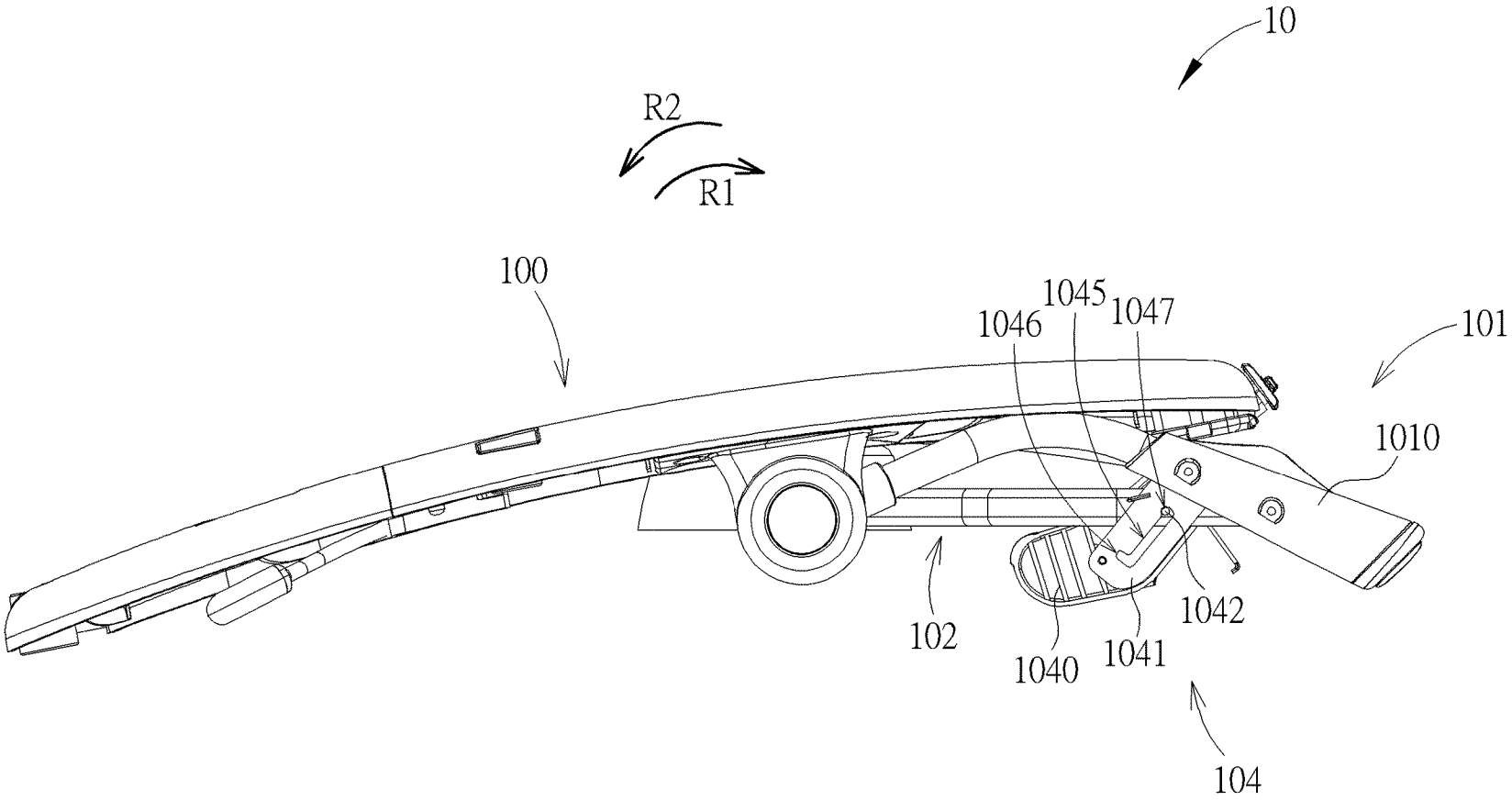

Please refer to FIG. 4 to FIG. 6. FIG. 4 is a diagram of the folding mechanism 104, the seat mount frame 101, and the upper frame 100 at different views according to the first embodiment of the present invention. FIG. 5 and FIG. 6 are lateral diagrams of the infant carrier 10 at different states according to the first embodiment of the present invention. As shown in FIG. 4 to FIG. 6, each of the two folding mechanisms 104 includes a fold bracket 1040, a slot configuration 1041, a pin 1042, a fold actuator 1043, and a resilient component 1044. The fold bracket 1040 is pivoted on the seat mount bracket 1010 of the seat mount frame 101. The slot configuration 1041 is disposed on the fold bracket 1040 and moves with the fold bracket 1040. The pin 1042 is disposed on the base frame 102 and inserted into the slot configuration 1041 to restrain the seat mount frame 101 from pivoting relative to the base frame 102 or to allow the seat mount frame 101 to pivot relative to the base frame 102 between the unfolded position as shown in FIG. 5 and the folded position as shown in FIG. 6. The fold actuator 1043 is attached onto the fold bracket 1040 for driving the fold bracket 1040 to slide the pin 1042 in the slot configuration 1041. Specifically, in this embodiment, the slot configuration 1041 includes a sliding slot 1045, a first engaging slot 1046, and a second engaging slot 1047. The first engaging slot 1046 and the second engaging slot 1047 are communicated with the sliding slot 1045 and disposed at two opposite ends of the sliding slot 1045. The resilient component 1044 biases the fold bracket 1040 to engage the pin 1042 inside the first engaging slot 1046 or the second engaging slot 1047. In this embodiment, the resilient component 1044 can be a torsional spring sheathed on a pivoting shaft of the folding bracket. However, it is not limited thereto.

Operational principle of the infant carrier 10 of the present invention is described as follows. When it is desired to unfold the seat mount frame 101 relative to the base frame 102 from the folded position as shown in FIG. 6 to the unfolded position as shown in FIG. 5, the fold bracket 1040 can be driven to move by lifting the fold actuator 1043, so that the pin 1042 moves from the second engaging slot 1047 into the sliding slot 1045, which allows the seat mount frame 101 to pivotally unfold relative to the base frame 102 along a first pivoting direction R1. During a process that the seat mount frame 101 pivotally unfolds relative to the base frame 102 along the first pivoting direction R1, the pin 1042 slides along the sliding slot 1045. When the seat mount frame 101 pivots relative to the base frame 102 to the unfolded position as shown in FIG. 5, the resilient component 1044 can bias the fold bracket 1040 to engage the pin 1042 inside the first engaging slot 1046 as long as the fold actuator 1043 has been released. Therefore, at this moment, the seat mount frame 101 is restrained from pivoting relative to the base frame 102 so as to be positioned in the unfolded position.

On the other hand, when it is desired to fold the seat mount frame 101 relative to the base frame 102 from the unfolded position as shown in FIG. 5 to the folded position as shown in FIG. 6, the fold bracket 1040 can be driven to move upwardly by lifting the fold actuator 1043 again, so that the pin 1042 moves from the first engaging slot 1046 into the sliding slot 1045, which allows the seat mount frame 101 to pivotally fold relative to the base frame 102 along a second pivoting direction R2 opposite to the first pivoting direction R1. During a process that the seat mount frame 101 pivotally folds relative to the base frame 102 along the second pivoting direction R2, the pin 1042 slides along the sliding slot 1045. When the seat mount frame 101 pivots relative to the base frame 102 to the folded position as shown in FIG. 6, the resilient component 1044 can bias the fold bracket 1040 to engage the pin 1042 inside the second engaging slot 1047 as long as the fold actuator 1043 has been released. Therefore, at this moment, the seat mount frame 101 is restrained from pivoting relative to the base frame 102 so as to be positioned in the folded position for easy storage and transportation.

Figure 7:
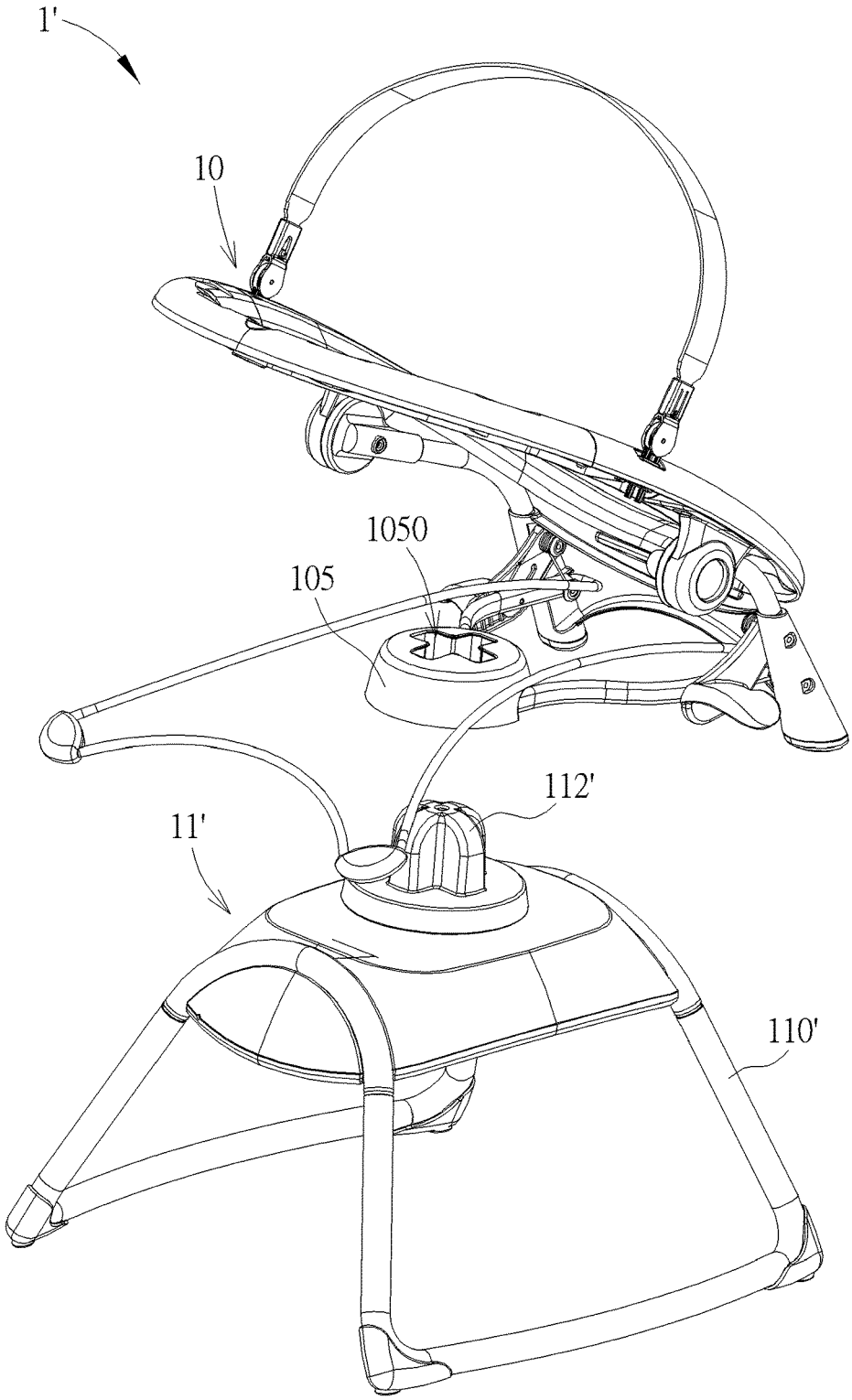
FIG. 7 is a partial exploded diagram of a swing device according to a second embodiment of the present invention.
Figure 8A:
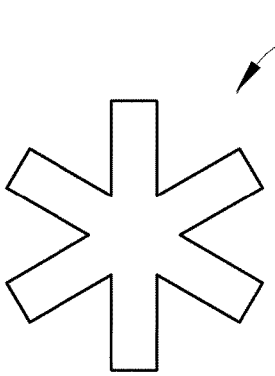
FIG. 8A to FIG. 8F are diagrams of a cross section of a mounting receiver according to different embodiments of the present invention.
Figure 8B:
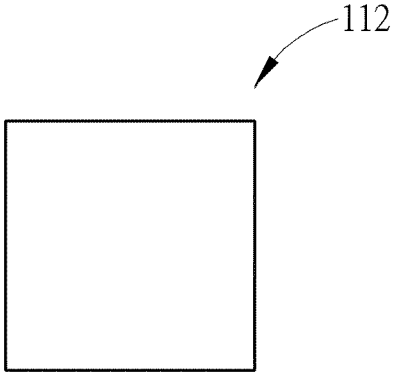
Figure 8C:
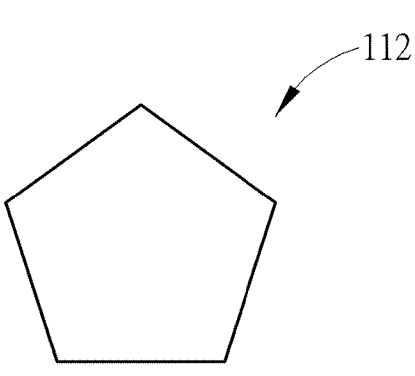
Figure 8D:
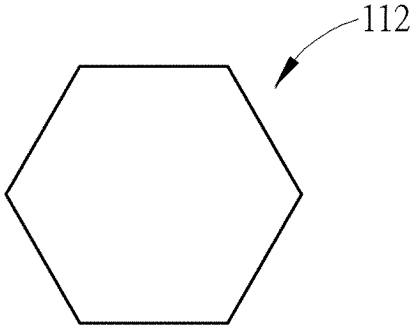
Figure 8E:
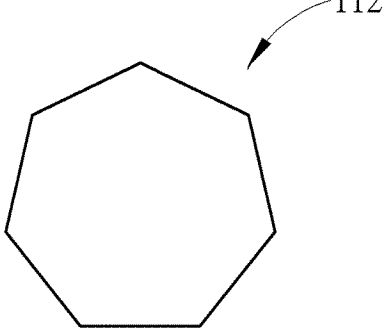
Figure 8F:
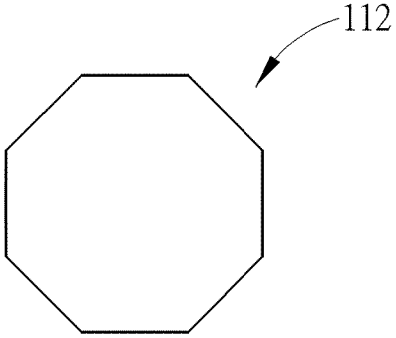

However, the structure of the swing assembly 11 of the present invention is not limited to those illustrated in the figures of the first embodiment. Please refer to FIG. 7. FIG. 7 is a partial exploded diagram of a swing device 1' according to a second embodiment of the present invention. Different from the swing assembly 11 of the first embodiment, a swing assembly 11' of the second embodiment includes a main frame 110' and a mounting receiver 112' but does not include any swing arm. The mounting receiver 112' is directly disposed on an upper surface of the main frame 110'. In this embodiment, the mounting slot 1050 and the cross section of the mounting receiver 112' can be cross-shaped. The infant carrier 10 can be mounted on the swing assembly 11' by cooperation of the mounting pod 105 and the mounting receiver 112' easily.

In contrast to the prior art, the present invention utilizes cooperation of the pin and the slot configuration of the folding mechanism for allowing the seat mount frame to pivot relative to the base frame between an unfolded position and a folded position. Therefore, it provides a convenient way for a user to fold the infant carrier for easy storage and transportation when the infant carrier is not in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant carrier comprising:

an upper frame;

a seat mount frame pivoted to the upper frame;

a base frame pivoted to the seat mount frame; and at least one folding mechanism disposed between the seat mount frame and base frame and for allowing the seat mount frame to pivot relative to the base frame between an unfolded position and a folded position, the at least one folding mechanism comprising:

a fold bracket pivoted on the seat mount frame, a pivoting point of the fold bracket and the seat mount frame and a pivoting point of the seat mount frame and the upper frame being located at different positions;

a slot configuration disposed on the fold bracket; and a pin disposed on the base frame and inserted into the slot configuration to restrain the seat mount frame from pivoting relative to the base frame or to allow the seat mount frame to pivot relative to the base frame.

2. The infant carrier of claim 1, wherein the slot configuration comprises a sliding slot, a first engaging slot and a second engaging slot, the first engaging slot and the second engaging slot are communicated with the sliding slot and disposed at two opposite ends of the sliding slot, the seat mount frame is restrained from pivoting relative to the base frame and respectively positioned in the unfolded position and the folded position when the pin is located within the first engaging slot and the second engaging slot, and the seat mount frame is allowed to pivot relative to the base frame when the pin is located within the sliding slot.

3. The infant carrier of claim 2, wherein the sliding slot is substantially perpendicular to the first engaging slot and the second engaging slot.

4. The infant carrier of claim 2, wherein the at least one folding mechanism further comprises a resilient component for biasing the fold bracket to engage the pin inside the first engaging slot or the second engaging slot.

5. The infant carrier of claim 1, wherein the at least one folding mechanism further comprises a fold actuator attached onto the fold bracket and for driving the fold bracket to slide the pin in the slot configuration.

6. The infant carrier of claim 1, wherein the base frame comprises a first end pivoted to the seat mount frame, the infant carrier further comprises a bounce wire connected to the first end of the base frame and extending away from the seat mount frame.

7. The infant carrier of claim 1, wherein the base frame comprises a first end pivoted to the seat mount frame and a second end opposite to the first end, the infant carrier further comprises a mounting pod disposed on the second end of the base frame.

8. The infant carrier of claim 7, wherein a mounting slot is formed on the mounting pod, and a shape of the mounting slot matches with a shape of a cross section of a mounting receiver of a device.

9. The infant carrier of claim 8, wherein the shape of the mounting slot and the shape of the cross section of the mounting receiver are axially symmetric-shaped.

10. The infant carrier of claim 9, wherein the shape of the mounting slot and the shape of the cross section of the mounting receiver are radial-shaped or regular polygon-shaped.

11. The infant carrier of claim 1, further comprising at least one recline mechanism disposed between the upper frame and the seat mount frame and for allowing the upper frame to pivot relative to the seat mount frame.

12. The infant carrier of claim 1, wherein the upper frame is pivoted to an upper portion of the seat mount frame, and the base frame is pivoted to a lower portion of the seat mount frame.

13. The infant carrier of claim 1, wherein the seat mount frame comprises a seat mount bracket and a seat mount tube, and a lower portion of the seat mount tube is received in the seat mount bracket.

14. A swing device comprising:

an infant carrier comprising:

an upper frame;

a seat mount frame pivoted to the upper frame;

a base frame pivoted to the seat mount frame;

at least one folding mechanism disposed between the seat mount frame and base frame and for allowing the seat mount frame to pivot relative to the base frame between an unfolded position and a folded position, the at least one folding mechanism comprising:

a fold bracket pivoted on the seat mount frame, a pivoting point of the fold bracket and the seat mount frame and a pivoting point of the seat mount frame and the upper frame being located at different positions;

a slot configuration disposed on the fold bracket and a pin disposed on the base frame and inserted into the slot configuration to restrain the seat mount frame from pivoting relative to the base frame or to allow the seat mount frame to pivot relative to the base frame; and a mounting pod disposed on the base frame; and a swing assembly coupled to the mounting pod for swinging the infant carrier.

15. The swing device of claim 14, wherein the swing assembly comprises:

a main frame; and a mounting receiver disposed on an upper surface of the main frame and coupled to the mounting pod.

16. The swing device of claim 15, wherein a mounting slot is formed on the mounting pod, and a shape of the mounting slot matches with a shape of a cross section of the mounting receiver.

17. The swing device of claim 16, wherein the shape of the mounting slot and the shape of the cross section of the mounting receiver are axially symmetric-shaped.

18. The swing device of claim 17, wherein the shape of the mounting slot and the shape of the cross section of the mounting receiver are radial-shaped or regular polygon-shaped.

19. The swing device of claim 14, wherein the swing assembly comprises:

a main frame;

a swing arm pendulously disposed on the main frame; and a mounting receiver disposed on the swing arm and coupled to the mounting pod.

20. The swing device of claim 19, wherein a mounting slot is formed on the mounting pod, and a shape of a cross section of the mounting slot matches with a shape of the mounting receiver.

21. The swing device of claim 20, wherein the shape of the mounting slot and the shape of the cross section of the mounting receiver are axially symmetric-shaped.

22. The swing device of claim 21, wherein the shape of the mounting slot and the shape of the cross section of the mounting receiver are radial-shaped or regular polygon-shaped.

23. The swing device of claim 14, wherein the slot configuration comprises a sliding slot, a first engaging slot and a second engaging slot, the first engaging slot and the second engaging slot are communicated with the sliding slot and disposed at two opposite ends of the sliding slot, the seat mount frame is restrained from pivoting relative to the base frame and respectively positioned in the unfolded position and the folded position when the pin is located within the first engaging slot and the second engaging slot, and the seat mount frame is allowed to pivot relative to the base frame when the pin is located within the sliding slot.

24. The swing device of claim 23, wherein the sliding slot is substantially perpendicular to the first engaging slot and the second engaging slot.

25. The swing device of claim 23, wherein the at least one folding mechanism further comprises a resilient component for biasing the fold bracket to engage the pin inside the first engaging slot or the second engaging slot.

26. The swing device of claim 14, wherein the at least one folding mechanism further comprises a fold actuator attached onto the fold bracket and for driving the fold bracket to slide the pin in the slot configuration.

27. The swing device of claim 14, wherein the base frame comprises a first end pivoted to the seat mount frame, the infant carrier further comprises a bounce wire connected to the first end of the base frame and extending away from the seat mount frame.

28. The swing device of claim 14, wherein the base frame comprises a first end pivoted to the seat mount frame and a second end opposite to the first end, and the mounting pod is disposed on the second end of the base frame.

29. The swing device of claim 14, wherein the infant carrier further comprises at least one recline mechanism disposed between the upper frame and the seat mount frame and for allowing the upper frame to pivot relative to the seat mount frame.

30. The swing device of claim 14, wherein the upper frame is pivoted to an upper portion of the seat mount frame, and the base frame is pivoted to a lower portion of the seat mount frame.

31. The swing device of claim 14, wherein the seat mount frame comprises a seat mount bracket and a seat mount tube, and a lower portion of the seat mount tube is received in the seat mount bracket.

* * * * *